US009133743B2

(12) United States Patent
Butzke

(10) Patent No.: US 9,133,743 B2
(45) Date of Patent: Sep. 15, 2015

(54) EXHAUST TREATMENT SECONDARY AIR SUPPLY SYSTEM

(75) Inventor: Gary Butzke, Brighton, MI (US)

(73) Assignee: Tenneco Automotive Operating Company Inc., Lake Forest, IL (US)

( * ) Notice: Subject to any disclaimer, the term of this patent is extended or adjusted under 35 U.S.C. 154(b) by 359 days.

(21) Appl. No.: 13/420,982

(22) Filed: Mar. 15, 2012

(65) Prior Publication Data

US 2013/0239548 A1 Sep. 19, 2013

(51) Int. Cl.

| | |
|---|---|
| ***F01N 3/00*** | (2006.01) |
| ***F01N 3/025*** | (2006.01) |
| ***F01N 3/32*** | (2006.01) |
| *F01N 11/00* | (2006.01) |
| *F02D 41/00* | (2006.01) |

(52) U.S. Cl.

CPC ..... *F01N 3/025* (2013.01); *F01N 3/326* (2013.01); *F01N 11/00* (2013.01); *F01N 2550/14* (2013.01); *F02D 41/0097* (2013.01)

(58) Field of Classification Search

CPC ..... F01N 3/025; F01N 3/326; F01N 11/00; F02D 41/0097

USPC ..... 60/272–324; 73/114.25; 123/198 C, 123/198 R

See application file for complete search history.

(56) References Cited

U.S. PATENT DOCUMENTS

| | | | | |
|---|---|---|---|---|
| 3,819,308 | A * | 6/1974 | Ishihara et al. | 418/181 |
| 5,081,836 | A * | 1/1992 | Smith et al. | 60/280 |
| 5,117,799 | A * | 6/1992 | Suzuki et al. | 123/561 |
| 5,519,992 | A * | 5/1996 | Hosoya et al. | 60/276 |
| 5,542,292 | A | 8/1996 | Schneider et al. | |
| 6,715,280 | B2 | 4/2004 | Lewis et al. | |
| 7,131,262 | B2 | 11/2006 | Sealy et al. | |
| 7,210,286 | B2 * | 5/2007 | Sun et al. | 60/295 |
| 7,293,406 | B2 | 11/2007 | Lewis et al. | |
| 7,980,061 | B2 * | 7/2011 | Kleinfeld | 60/280 |
| 8,230,679 | B2 * | 7/2012 | Frazier et al. | 60/295 |
| 8,438,837 | B2 * | 5/2013 | Hermansson et al. | 60/286 |
| 2004/0088969 | A1 | 5/2004 | Lewis et al. | |
| 2007/0214777 | A1 * | 9/2007 | Allansson et al. | 60/299 |
| 2007/0274858 | A1 | 11/2007 | Childers et al. | |
| 2009/0100826 | A1 | 4/2009 | Stewart et al. | |
| 2009/0241520 | A1 * | 10/2009 | Gendron et al. | 60/295 |
| 2009/0277430 | A1 | 11/2009 | Ernst et al. | |
| 2009/0313975 | A1 * | 12/2009 | McCombs | 60/290 |
| 2010/0031643 | A1 | 2/2010 | Cox et al. | |

(Continued)

FOREIGN PATENT DOCUMENTS

| | | |
|---|---|---|
| EP | 2336537 | 6/2011 |

*Primary Examiner* — Thomas Denion
*Assistant Examiner* — Kelsey Stanek
(74) *Attorney, Agent, or Firm* — Harness, Dickey & Pierce, P.L.C.

(57) ABSTRACT

A system for treating the exhaust output by an internal combustion engine includes a regeneration positioned upstream from a diesel particulate filter. The regeneration unit combusts a fuel to heat the exhaust entering the diesel particulate filter. An air pump supplies a secondary source of compressed air to the regeneration unit and is adapted to be driven by the internal combustion engine. A speed sensor is coupled to the air pump and operable to output a signal indicative of a rotational speed of an air pump component. A controller receives the speed sensor signal and determines an operating speed of the internal combustion engine based on the speed sensor signal. The controller controls the regeneration unit based on the engine operating speed.

24 Claims, 2 Drawing Sheets

(56) References Cited

U.S. PATENT DOCUMENTS

Figure 1:
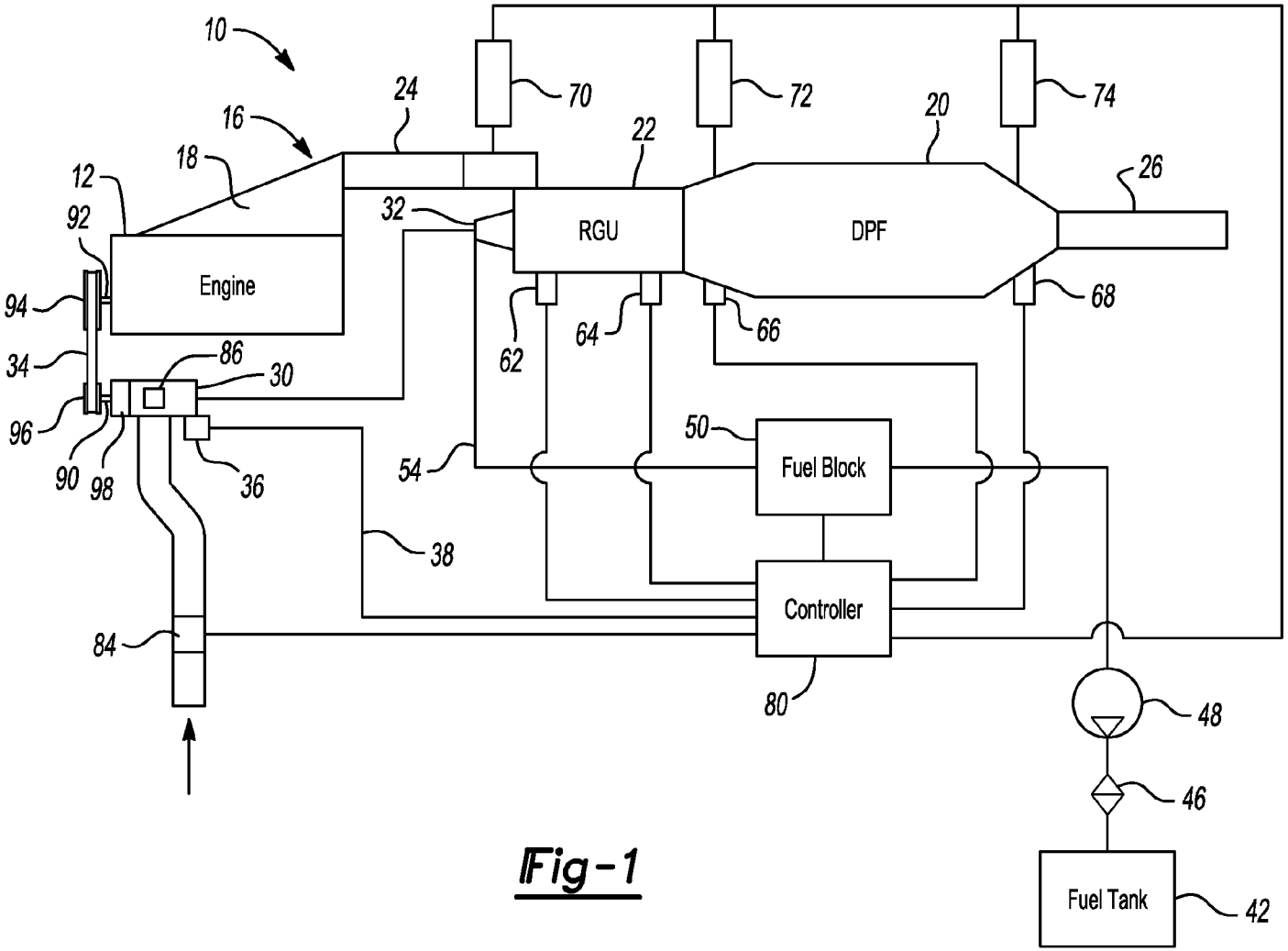

2011/0146244 A1* 6/2011 Farman et al. ..... 60/285
2011/0283685 A1 11/2011 Kotrba et al.
2011/0289906 A1 12/2011 Morley et al.
2013/0276445 A1* 10/2013 Chen et al. ..... 60/605.1

* cited by examiner

EXHAUST TREATMENT SECONDARY AIR SUPPLY SYSTEM

FIELD

The present disclosure generally relates to an exhaust treatment system. More particularly, a secondary air system includes an air pump and an associated speed sensor for managing the operation of a regeneration unit positioned upstream from a diesel particulate filter.

BACKGROUND

This section provides background information related to the present disclosure which is not necessarily prior art.

Many personal and commercial vehicles have been constructed with an internal combustion engine for transferring power to the driven wheels of the vehicle. Older vehicles may be equipped with exhaust systems that may not meet present governmental regulatory standards or standards that are about to be imposed. When new, these vehicles may have met the emissions control regulations but these vehicles may require modification to be legally operated in the future.

In one example, commercial vehicles such as buses may be equipped with a diesel fueled internal combustion engine having an exhaust system that does not include a diesel particulate filter or a regeneration unit associated with the diesel particulate filter. In addition, many of these same vehicles have relatively simple engine and driveline arrangements where an electronic engine controller is not provided.

It may be desirable to retrofit certain vehicles with exhaust systems including a diesel particulate filter and a regeneration unit. Some emissions control systems require a real time indication of engine operating speed to properly manage the regeneration unit. Furthermore, operation of the regeneration unit may require a secondary supply of oxygen that may be provided by an external air pump. Accordingly, it may be desirable to provide an exhaust system including a diesel particulate filter, a regeneration unit, a secondary air supply including an air pump where the air pump is equipped with a sensor operable to output a signal indicative of the internal combustion engine speed.

SUMMARY

This section provides a general summary of the disclosure, and is not a comprehensive disclosure of its full scope or all of its features.

A system for treating the exhaust output by an internal combustion engine includes a regeneration positioned upstream from a diesel particulate filter. The regeneration unit combusts a fuel to heat the exhaust entering the diesel particulate filter. An air pump supplies a secondary source of compressed air to the regeneration unit and is adapted to be driven by the internal combustion engine. A speed sensor is coupled to the air pump to output a signal indicative of a rotational speed of an air pump component. A controller receives the speed sensor signal and determines an operating speed of the internal combustion engine based on the speed sensor signal. The controller controls the regeneration unit based on the engine operating speed.

A method of treating exhaust output by an internal combustion engine includes obtaining a signal indicative of the rotating speed of a member of an air pump driven by the internal combustion engine. An engine speed is determined based on the signal. An exhaust mass air flow rate is estimated based on the engine speed. A secondary air flow rate and a fuel rate are determined based on the estimated exhaust mass air flow rate. The secondary air flow and fuel are provided to a regeneration unit at the determined rates. The fuel in the regeneration unit is ignited to increase the temperature of exhaust flowing therethrough to regenerate a diesel particulate filter.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 2:
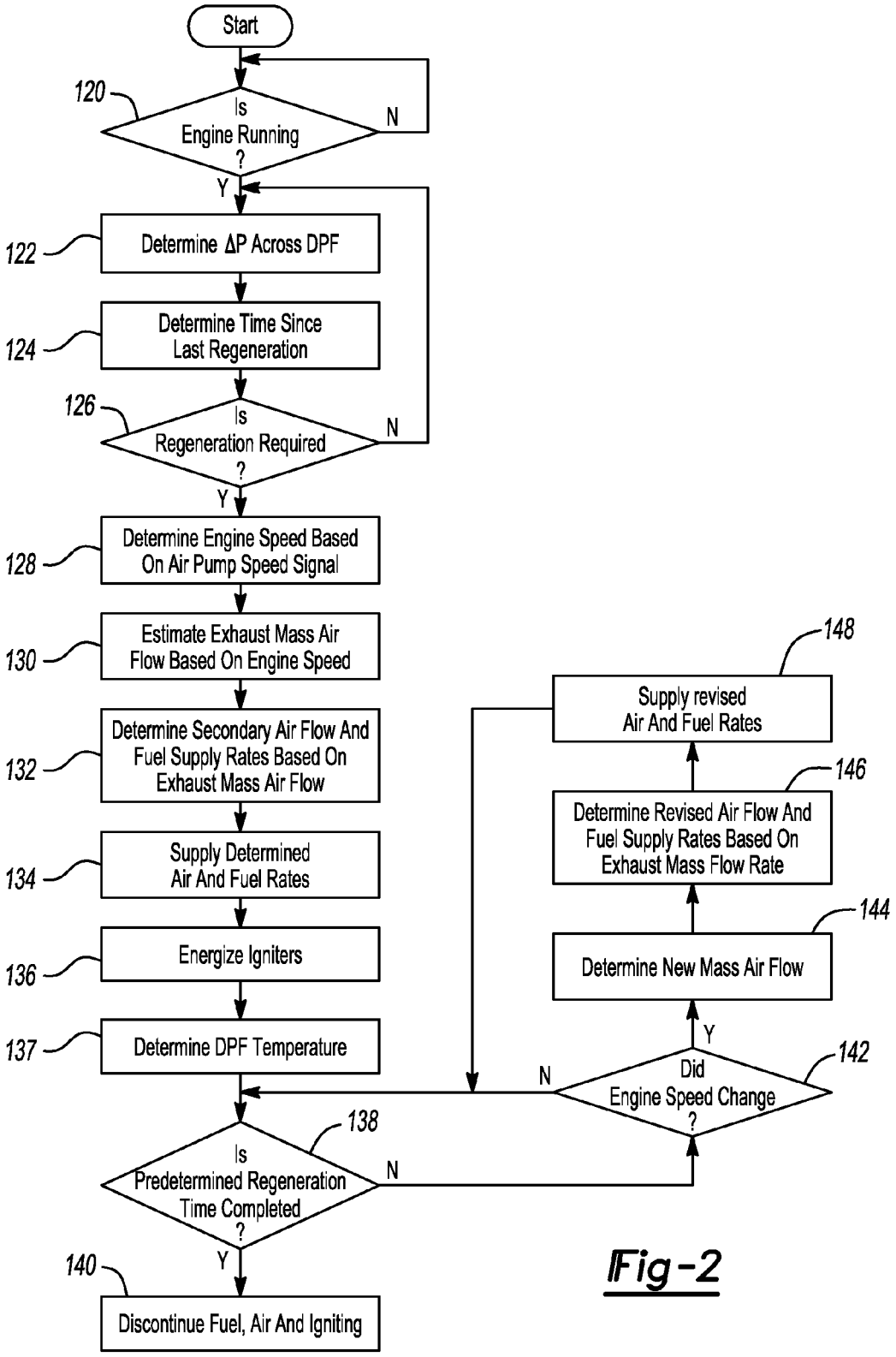

FIG. 1 is a schematic depicting an exemplary vehicle equipped with an exhaust treatment system constructed in accordance with the teachings of the present disclosure; and FIG. 2 is a flow chart depicting a control scheme for the exhaust treatment system shown in FIG. 1.

Corresponding reference numerals indicate corresponding parts throughout the several views of the drawings.

DETAILED DESCRIPTION

Example embodiments will now be described more fully with reference to the accompanying drawings.

With reference FIG. 1, an exemplary vehicle 10 is equipped with an engine 12 and an exhaust system 16. Exhaust system 16 includes an exhaust manifold 18, a diesel particulate filter 20 and a regeneration unit 22. An exhaust conduit 24 interconnects exhaust manifold 18 and regeneration unit 22. A tail pipe 26 includes one end in receipt of gasses passing through diesel particulate filter 20 and an opposite open end allowing the treated exhaust to exit exhaust system 16.

Exhaust system 16 also includes an air pump 30 providing a supply of secondary air to an inlet 32 of regeneration unit 22. Air pump 30 is drivingly coupled to engine 12 by a flexible drive member 34 such as a belt or chain. Alternatively, air pump 30 may be driven by engine 12 using any other power transmission device such as a gear train. A speed sensor 36 is coupled to air pump 30 and configured to output a signal 38 indicative of the rotational speed of engine 12.

A tank 42 stores a hydrocarbon such as diesel fuel. A fuel filter 46 and a fuel pump 48 are provided to transfer the hydrocarbon from fuel tank 42 to a fuel block 50. Fuel block 50 selectively supplies fuel to a fuel line 54 terminating at inlet 32 of regeneration unit 22.

Regeneration unit 22 includes a first igniter 62 and a second igniter 64 to ignite fuel and increase the temperature of the exhaust travelling therethrough. More particularly, first igniter 62 may be referred to as a primary igniter for combusting the fuel supplied by fuel line 54 with the secondary air provided by air pump 30. Second igniter 64 may be operable to combust hydrocarbons present in the exhaust downstream from first igniter 62. It should be appreciated that the regeneration unit may be equipped with only a single igniter without departing from the scope of the invention.

A first pressure sensor 66 is positioned in communication with the exhaust flowing through exhaust system 16 at a position upstream from diesel particulate filter 20. A second pressure sensor 68 is in communication with the exhaust at a position downstream from diesel particulate filter 20. Each of first pressure sensor 66 and second pressure sensor 68 output a signal indicative of the exhaust pressure at their locations.

A first temperature sensor 70 is positioned within exhaust system 16 at a location upstream from regeneration unit 22. A second temperature sensor 72 is operable to output a signal indicative of the exhaust temperature at a position downstream from regeneration unit 22 and upstream from diesel particulate filter 20. A third temperature sensor 74 is operable to output a signal indicative of the exhaust temperature at a location downstream from diesel particulate filter 20. A controller 80 is in receipt of signals from first through third temperature sensors 70, 72, 74 as well as signal 38 indicating the rotational speed of engine 12. First pressure sensor 66 and second pressure sensor 68 send signals indicating the exhaust pressure at their locations to controller 80.

Controller 80 is in communication with fuel block 50 to selectively supply fuel to fuel line 54. An air valve 84 controls the supply of outside air to regeneration unit 22. Controller 80 may selectively open and close air valve 84 to meter the flow rate of secondary air provided to regeneration unit 22. Air valve 84 may be positioned upstream or downstream of air pump 30 to perform this function.

The duration of regeneration may be based on engine speed, one or more pressure differentials, or some other calculation performed by controller 80. For example, regeneration of diesel particulate filter 20 may be determined to be completed once the exhaust flowing through DPF 20 is above a predetermined temperature threshold for a predetermined amount of time.

Speed sensor 36 is coupled to air pump 30 or integrally formed therewith. Speed sensor 36 may include a Hall Effect or variable reluctance type sensor. In one arrangement, the sensor target may be a toothed wheel fixed to a rotating member within air pump 30. The sensor target may include the teeth of an existing gear 86 already present within air pump 30. Other arrangements including patterned shafts are contemplated as being within the scope of the present disclosure.

Air pump 30 includes an input shaft 90 driven by flexible member 34. Controller 80 is provided the geometrical relationship between the rotational speed of a crankshaft 92 of engine 12 and input shaft 90 of air pump 30. This relationship may be as simple as the ratio of the diameters of an output pulley 94 fixed to crankshaft 92 and an input pulley 96 fixed to input shaft 90. Regardless of the mechanical arrangement, sensor 36 is operable to output signal 38 indicative of the rotational speed of crankshaft 92.

Input shaft 90 may be driven by any other number of intermediate pulleys such as an alternator pulley, a water pump pulley, a power steering pump pulley or the like. The relationship of the intermediate pulley speed to the speed of crankshaft 92 could be taken into account to accurately provide signal 38 to controller 80. Air pump 30 may be associated with or include a clutch 98 operable to drivingly connect and disconnect input shaft 90 from a pumping member (not shown) within air pump 30. The pumping member may be disconnected from engine 12 to save energy and reduce wear on air pump 30 when secondary air is not required.

It is contemplated that exhaust system 16 depicted in FIG. 1 represents a modified exhaust system arranged by retrofitting an existing vehicle. In particular, an aftermarket retrofit kit including regeneration unit 22, diesel particulate filter 20, air pump 30, speed sensor 36, air valve 84, pressure sensors 66, 68, temperature sensors 70, 72, 74, igniters 62, 64, fuel block 50 and controller 80 may be used to modify a vehicle that was not originally equipped with such an exhaust aftertreatment system. A complex and costly engine controller does not need to be included with the original vehicle or the proposed exhaust aftermarket retrofit kit. Sufficient data is provided from speed sensor 36 to controller 80 to properly manage the operation of regeneration unit 22 and diesel particulate filter 20.

FIG. 2 provides a representative flow diagram related to the operation of exhaust system 16. At block 120, control determines whether engine 12 is running. If the engine is running, control determines the pressure differential across DPF 20 at block 122. Controller 80 compares the pressure signal provided from first pressure sensor 66 to the signal provided from second pressure sensor 68 and calculates a pressure differential. At block 124, control determines the amount of engine running time that has elapsed since the last DPF regeneration. Engine operating time may be determined based on the output from speed sensor 36.

At block 126, control determines whether a regeneration of diesel particulate filter 20 is required. At this time, controller 80 determines whether the determined time since the last regeneration event is greater than a predetermined interval. If so, a regeneration is required. Controller 80 also compares the recently determined pressure differential across diesel particulate filter 20 to a threshold pressure differential. If the determined pressure differential is greater than the predetermined threshold, a regeneration event is required. As DPF 20 becomes filled with soot and other particulate matter, the pressure differential across DPF 20 increases thereby indicating a need for regeneration.

At block 128, control determines the rotating speed of crankshaft 92 of engine 12 based on signal 38 from sensor 36. At block 130, an exhaust mass air flow provided to regeneration unit 22 is calculated based on the previously determined engine speed. At block 132, control determines a secondary air flow rate and a rate of fuel flow to be provided to line 54 based on the exhaust mass air flow previously determined.

At block 134, the determined air flow rate is provided by engaging clutch 98, if present, and controlling valve 84 to provide the desired secondary air flow rate to inlet 32 of regeneration unit 22. Controller 80 controls pump 48 and fuel block 50 to provide the determined rate of fuel supply to line 54 and inlet 32 of regeneration unit 22. Control energizes igniters 62 and 64 at block 136.

At block 137, control determines the average temperature of the exhaust flowing through diesel particulate filter 20. Signals output from third temperature sensor 74 and second temperature sensor 72 may be combined and averaged to determine the average operating temperature of exhaust flowing through DPF 20.

Controller 80 may also or alternatively determine an engine load condition by evaluating speed sensor signal 38 as well as temperature signals provided by sensors 70, 72 and 74. The regeneration duration may be varied based on the engine load.

At block 138, control determines whether a predetermined regeneration time at sufficient temperature has been completed. Once the regeneration has occurred at an average temperature greater than a threshold temperature for a predetermined minimum time, control continues to block 140 where the supply of fuel and secondary air to regeneration unit 22 are ceased. First igniter 62 and second igniter 64 are no longer energized. At this time, the regeneration of DPF 20 is complete.

Control also provides for a modification of the regeneration process if a change in engine speed should occur during the regeneration process. At block 142, control determines whether the engine speed has changed during regeneration by evaluating signal 38 from speed sensor 36. If the engine speed has changed, control determines a revised mass air flow based on the engine speed signal at block 144. At block 146, control determines a revised secondary air flow rate and a revised fuel supply rate based on the revised exhaust mass air flow rate. At block 148, control varies the inputs to air valve 84 and fuel block 50 to supply the revised secondary air flow rate and fuel flow rate to regeneration unit 22. Control returns to blocks 138 and 140 as previously described to complete the regeneration process.

It should be appreciated that speed sensor 36 may also be used to support a diagnostic system where signal 38 may be evaluated to confirm that a member such as input shaft 90 of air pump 30 is being rotated. Pump operation may be simply verified using this technique. Additional diagnosis may be performed to confirm proper pump operating speed and operation of clutch 98 if the rotational speed of crankshaft 92 is known from another source. Control may compare the determined crankshaft operating speed based on signal 38 to the engine operating speed supplied from the second source during a diagnostic check.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An exhaust system retro-fit kit, comprising:

a diesel particulate filter, a regeneration unit, an air pump fitted with a speed sensor, and a controller, the retro-fit kit adapted to modify an existing exhaust system in receipt of exhaust output by an internal combustion engine, the diesel particulate filter being adapted to receive the exhaust;

the regeneration unit including at least one of an igniter and an inlet and adapted to be positioned upstream of the diesel particulate filter and operable to combust a fuel supplied thereto and heat the exhaust entering the diesel particulate filter;

the air pump supplying a secondary source of compressed air to the regeneration unit, the air pump being adapted to be driven by the internal combustion engine;

the speed sensor coupled to the air pump and operable to output a signal indicative of a rotational speed of an air pump component; and the controller being configured to receive the speed sensor signal and configured to determine an operating speed of the internal combustion engine based on the speed sensor signal, the controller controlling the regeneration unit based on the determined engine operating speed and adapted to operate independently from an engine control system.

2. The exhaust treatment system of claim 1, wherein the controller is operable to determine an operating speed of the air pump.

3. The exhaust treatment system of claim 1, wherein the regeneration unit includes the igniter and another axially spaced apart igniter.

4. The exhaust treatment system of claim 1, further including an air valve in communication with the air pump and controlled by the controller to provide a target secondary air flow rate to the regeneration unit.

5. The exhaust treatment system of claim 4, further including a drive system adapted to transfer torque from the internal combustion engine to the air pump.

6. The exhaust treatment system of claim 5, wherein the drive system includes a flexible drive member driving a pulley fixed to an input shaft of the air pump.

7. The exhaust treatment system of claim 6, wherein the speed sensor is operable to output a signal indicative of the rotational speed of the input shaft.

8. The exhaust treatment system of claim 1, further including a clutch adapted to drivingly couple and decouple the air pump from the internal combustion engine, the clutch being controlled by the controller.

9. The exhaust treatment system of claim 1, further including a first pressure sensor positioned upstream of the diesel particulate filter and a second pressure sensor positioned downstream of the diesel particulate filter, the controller being in receipt of signals output by the first and second pressure sensors to determine whether a pressure drop threshold has been exceeded, the controller initiating combustion within the regeneration unit based on the pressure drop across the diesel particulate filter.

10. A method of treating exhaust output by an internal combustion engine, comprising:

retro-fitting an existing exhaust system to include a regeneration unit and an air pump;

installing a sensor on the air pump to obtain a signal indicative of a rotating speed of a member of the air pump driven by the internal combustion engine;

determining an engine speed based on the signal independently from an engine controller;

estimating an exhaust mass air flow rate based on the determined engine speed;

determining a secondary air flow rate and a fuel rate to be provided to the regeneration unit based on the estimated exhaust mass air flow rate, the regeneration unit including at least one of an igniter and an inlet and being positioned upstream from a diesel particulate filter;

pumping the secondary air flow and the fuel at the determined rates to the regeneration unit, the secondary air flow being provided by the air pump to the inlet; and using the igniter to ignite the fuel in the regeneration unit to increase the temperature of exhaust flowing therethrough to regenerate the diesel particulate filter.

11. The method of claim 10, further including determining a pressure drop across the diesel particulate filter and initiating diesel particulate filter regeneration based on the pressure drop exceeding a predetermined threshold.

12. The method of claim 10, further including evaluating the signal to determine whether the engine speed has changed while the fuel is being ignited.

13. The method of claim 12, further including determining a revised exhaust mass air flow rate based on the changed engine speed.

14. The method of claim 13, further including determining a revised secondary air flow rate and a revised fuel rate to be provided to the regeneration unit based on the revised exhaust mass air flow rate.

15. The method of claim 14, further including supplying the revised secondary air flow rate and the revised fuel rate to the regeneration unit and igniting the fuel.

16. The method of claim 10, further including determining an engine running time elapsed since a last regeneration of the diesel particulate filter and operating the regeneration unit again once a predetermined amount of running time has elapsed.

17. The method of claim 10, further including coupling a speed sensor to the air pump, the speed sensor outputting the signal.

18. The method of claim 17, wherein the rotating member of the air pump includes an input shaft.

19. The method of claim 17, wherein the rotating member of the air pump includes an internal gear.

20. The method of claim 17, wherein the speed sensor includes a Hall Effect sensor.

21. The method of claim 17, wherein the speed sensor includes a variable reluctance type sensor.

22. The method of claim 17, further including performing a diagnostic check to determine whether the air pump is being rotated by evaluating the air pump speed sensor signal.

23. The method of claim 22, further including performing another diagnostic check to determine whether a clutch drivingly interconnecting the internal combustion engine and the air pump is operating by evaluating the air pump speed sensor signal.

24. The method of claim 10, further including comparing the determined engine speed to another source of engine speed to perform a diagnostic check of the air pump.

* * * * *